US007100529B2

(12) United States Patent
Hlavin

(10) Patent No.: US 7,100,529 B2
(45) Date of Patent: Sep. 5, 2006

(54) DECORATIVE DISPLAY FLAG FOR ROTATABLE ATTACHMENT TO MOVABLE POLES FOR RESIDENTIAL AND COMMERCIAL USES

(75) Inventor: Dale J. Hlavin, Westlake, OH (US)

(73) Assignee: Markers, Inc., Westlake, OR (US)

( * ) Notice: Subject to any disclaimer, the term of this patent is extended or adjusted under 35 U.S.C. 154(b) by 10 days.

(21) Appl. No.: 11/099,285

(22) Filed: Apr. 5, 2005

(65) Prior Publication Data

US 2005/0172884 A1 Aug. 11, 2005

Related U.S. Application Data

(63) Continuation-in-part of application No. 10/674,708, filed on Sep. 30, 2003, now Pat. No. 7,062,873.

(51) Int. Cl.
*G09F 17/06* (2006.01)

(52) U.S. Cl. ..... 116/173

(58) Field of Classification Search ..... 116/173, 116/174, 28 R, 209

See application file for complete search history.

(56) References Cited

U.S. PATENT DOCUMENTS

| | | | | |
|---|---|---|---|---|
| 2,906,234 | A * | 9/1959 | Scott | 116/173 |
| 3,242,901 | A * | 3/1966 | Olson | 116/173 |
| 3,636,912 | A * | 1/1972 | Kamp | 116/173 |
| 4,114,879 | A * | 9/1978 | Oiler | 116/173 |
| 4,375,134 | A * | 3/1983 | Sheetz | 116/173 |
| 5,253,608 | A * | 10/1993 | Burke | 116/173 |
| 5,706,756 | A * | 1/1998 | Cunningham et al. | 116/173 |
| 5,904,116 | A * | 5/1999 | Wyner et al. | 116/173 |
| 5,943,980 | A * | 8/1999 | Huang | 116/173 |
| 6,389,659 | B1 * | 5/2002 | Jacobs | 116/173 |
| 6,672,243 | B1 * | 1/2004 | Seymour et al. | 116/173 |

FOREIGN PATENT DOCUMENTS

DE 3810260 A1 * 10/1989

(Continued)

*Primary Examiner*—Diego Gutierrez
*Assistant Examiner*—Travis Reis
(74) *Attorney, Agent, or Firm*—Hudak, Shunk & Farine Co. LPA

(57) ABSTRACT

A decorative residential or commercial flag for attachment to a supporting upright pole having flag attachment means comprising a linear sleeve adapted to loosely slip over the upright pole to enable unobstructed rotation of the flag in response to wind direction along with a flexible tab secured to the top of the linear sleeve adapted to rotatably engage an upwardly extending narrow pin located at the top of the upright pole. The flexible tab contains an opening larger than the narrowed upright extension to enable free rotation of the tab around the narrowed extension, while the opening is smaller than the upright pole to enable the larger diameter pole to vertically support the flexible tab. The flexible tab supports the decorative flag vertically on the upright pole while the sleeve enables circumferential rotation of the decorative flag about the axis of the upright pole. The decorative flag can be attached directly to an upright pole or inclined pole. Preferred flags are outdoors flags supported vertically by inserting the bottom end of the pole into a ground socket sunk into the ground flush with the ground, which permits expedient installation of the flag pole and easy removal of the pole for storage or rearrangement if desired. Alternatively the flagpole can be supported by a weighted holder resting on interior furniture or floors, or outside on a patio or other flat surface.

11 Claims, 4 Drawing Sheets

FOREIGN PATENT DOCUMENTS

DE 10120544 A1 * 11/2002

JP 08328499 A * 12/1996

* cited by examiner

DECORATIVE DISPLAY FLAG FOR ROTATABLE ATTACHMENT TO MOVABLE POLES FOR RESIDENTIAL AND COMMERCIAL USES

RELATED PATENT INFORMATION

This application is a Continuation-in-Part Application of U.S. patent application Ser. No. 10/674,708, filed Sep. 30, 2003 now U.S. Pat. No. 7,062,873, for a "GOLF MARKING FLAG FOR ATTACHMENT TO MOVABLE POLES FOR MARKING HOLE LOCATION IN GOLF COURSE GREENS".

FIELD OF THE INVENTION

This invention pertains to decorative display flags on movable poles for exterior or interior use on residential and commercial properties to display decorative colors graphics, numbers, lettering, or similar display.

BACKGROUND OF THE INVENTION

Residential dwellers as well as commercial properties frequently like to display colorful decorative flags to attract attention or provide informative to the public. Such flags can be multiple color whimsical design of random or a set pattern of colors, graphics, numbers, lettering or similar design identifying school or organization affiliation or advertising brand name colors or company colors and products, union or club affiliation, brand names, high school or collage colors and/or logos, professional sport team colors and logos, commercial names, sales information, national flags, patriotic and community displays, political information, and similar indicia decorative flags displaying information such as announcements for birthdays, anniversaries, marriages, awards, addresses, directions, building names or numbers, and the like. Co-pending and commonly assigned Ser. No. 10/194,708 discloses and claims a movable golf marking flag for attachment to movable poles for marking hole locations in golf course greens depending on pin placement on the greens. The golf marking flags are attached to movable upright poles or pins which in turn are inserted into preset cups or holes disposed in the greens.

Prior to this invention decorative display flags such as an American flag frequently were simple cloth flags tied to poles or adapted to be tied to poles or some other structure by simple tie knot connections or some intervening mechanical interconnection. Flag poles for this purpose ordinarily are permanently fixed into the ground or securely attached to a structure to permit the flag pole to stand upright and permit the flag to extend outwardly with the wind without blowing over. For instance, U.S. Pat. No. 5,572,835 discloses a flag pole permanently set in concrete and a flag attached to the pole by intervening rings forming part of the pole assembly. Similarly U.S. Pat. No. 5,975,009 suggests wire retainer clips for attaching the flag to the pole, while U.S. Pat. No. 5,943,980 suggests connecting rings for connecting a banner to a pole, where multiple rigid metal connection assemblies are required for attaching and vertically supporting the flags on the poles. Intervening mechanical connectors are difficult and cumbersome to assemble and disassemble necessitating existing poles to be retrofitted with connectors to hang a flag on a pole. Permanently secured poles are difficult to remove from set locations and cannot be easily moved to change location of the flag pole or flag poles or rearrange multiple poles to change the overall flag display. In brisk winds, the flag tied to the pole remains fixed in a circumferential position while the wind causes the flag to wrap around the pole. Flags not securely tied or knotted to the pole can fall off due to the ties loosening. Smaller exterior or interior decorative flags were often permanently glued or otherwise permanently secured to sticks. Interior flags can be displayed in building lobbies or personal offices or conference rooms, while interior residential flags can be displayed in game rooms or family rooms. Although interior flags are not subjected to outside weather or wind, such flags ordinarily were permanently fixed to a pole thereby preventing easy detachment and interchangeability of multiple flags depending on the season or occasion.

SUMMARY OF THE INVENTION

It now has been found that an improved self supporting decorative flag adapted to be rotationally attached on an upright pole enables free rotation of the flag in the wind and avoids wrapping of the flag about the pole and eliminates cumbersome intervening mechanical connectors and insecure tie attachments to the pole. The self supporting decorative flag can be easily attached or detached and interchanged with other design flags as desired. The decorative flag of this invention comprises a field with a linear side attachment sleeve integral with the flag where the sleeve is adapted to slip freely over an upright flag pole and supported in conjunction with a flexible tab secured to the top part of the sleeve adapted to rotatably engage the top of the upright pole and maintain vertical support for the decorative flag on the pole, whereby the flag is free to rotate about the pole in response to wind direction. The flexible tab contains an opening adapted to rotatably fit over an upwardly extending narrow diameter pin or threaded screw extension secured to the top of the larger diameter upright pole. The sleeve maintains engagement with the pole and enables 360 degree flag rotation, while the flexible tab vertically supports the flag and permits unobstructed rotation of the decorative flag. The marking flag of this invention provides a removable self-supporting flag along with self-supporting attachment directly to an upright pole without need for an interconnecting means for attaching the decorative flag to the upright pole. The sleeve and flexible tab combination enables expedient attachment and removal of the marking flag to the pole. If desired, a removable plastic tube can be inserted into flag sleeve to facilitate rotation on the pole without deteriorating wear. The upright pole can be removably inserted into a ground socket located in the ground disposed flush with the ground, while interior poles can be supported by weighted holders resting on the floor or on furniture. Although the decorative flag of this invention is particularly suitable for attachment to vertical poles, it can be similarly attached to inclined or lateral poles supported by vertical structures. These and other advantages of this invention will be more apparent by referring to the drawings and the detailed description of the invention.

IN THE DRAWINGS

DETAILED DESCRIPTION OF THE INVENTION

Figure 1:
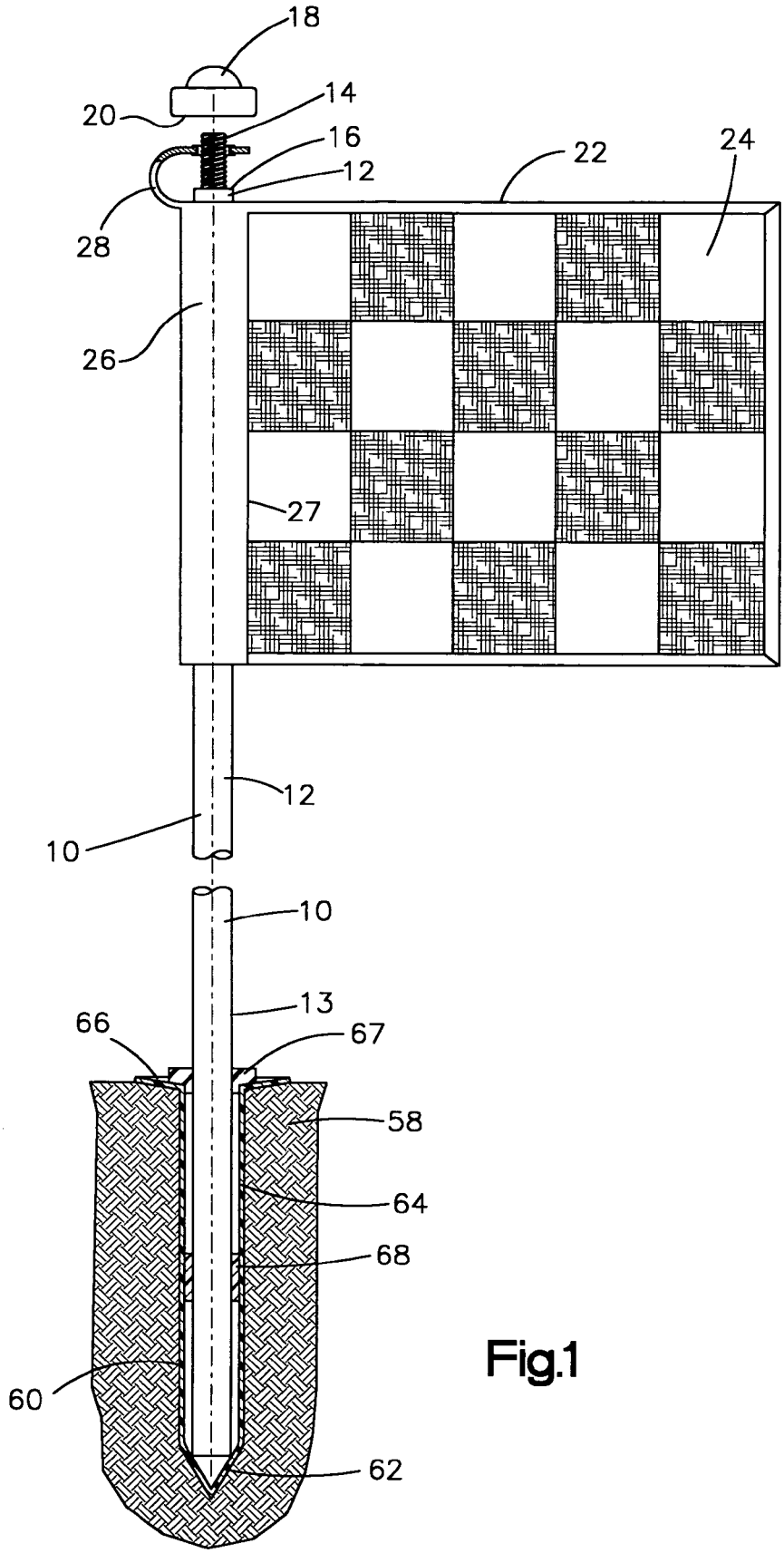
FIG. 1 is a front elevation view of an outdoor upright pole supporting the decorative flag of this invention.
Figure 2:
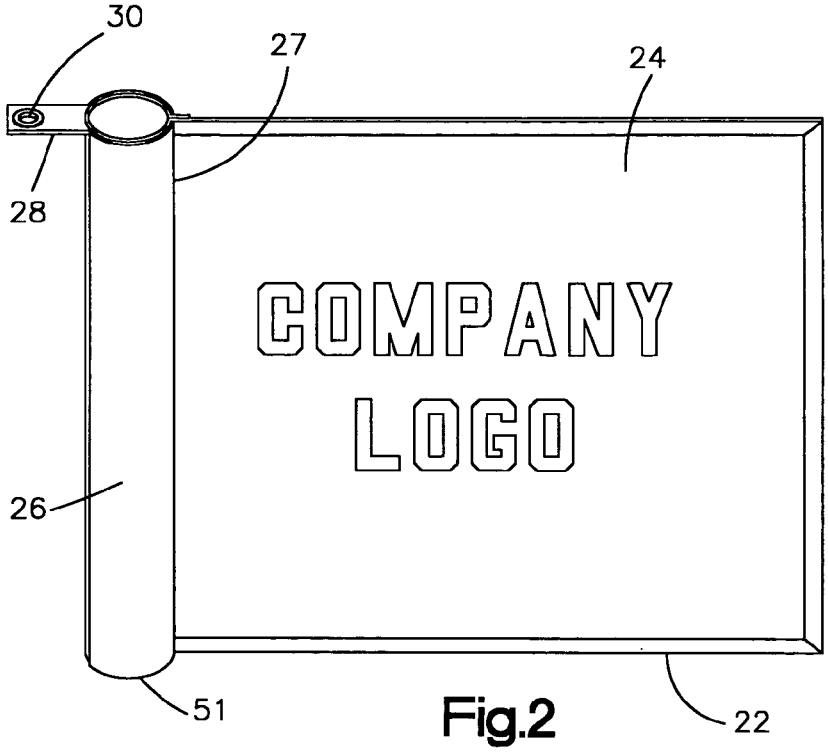
FIG. 2 is front elevation perspective view of the decorative flag of this invention for attachment to the upright pole shown in FIG. 1.

Referring now to the drawings wherein like reference numbers designate like parts, shown in FIG. 1 is a preferred embodiment of this invention showing a flag pole 10 with an exterior decorative flag 22 attached to the pole 10 in accordance with this invention. The flag pole 10 comprises an upper pole section 12 terminated at the top end with an upwardly extending smaller diameter pin or threaded screw 14. The juncture of the larger diameter pole 12 and the reduced diameter threaded pin or screw 14 forms an intervening laterally disposed peripheral shoulder 16. The upright threaded screw 14 is adapted to engage a threaded capping nut 18 having a lower edge 20 and internal threads with a threaded depth of about one-half of the vertical length of threaded screw 14 to leave vertical spacing of about one-half the vertical length of the screw 14 between the lower edge 20 of the capping nut 18 and the peripheral shoulder 16 when the capping nut 18 is tightened downwardly onto the upright screw 14. The relative lengths of the upwardly extending threaded screw 14 relative to the tightened capping nut 18 are not critical, but merely illustrative to suggest useful relative dimensions that provide vertical spacing between the capping nut lower edge 20 and the peripheral shoulder 16 when the capping nut 18 is tightened on the upright screw 14.

The decorative flag 22 of this invention comprises a field 24 normally displaying color designs and/or some sort of graphics, lettering or numbers as desired. The decorative flag comprises a vertical hemmed sleeve 26 integral with the flag 22 on the left side of the field 24, along with an extending bendable flexible tab member 28 secured to the top of the sleeve 26. The flexible tab 28 contains an interior opening or grommet 30 adapted to slip over the upwardly extending screw 14. The vertical sleeve 26 of the flag 22 can be formed by sewing or otherwise securing the sleeve 26 at the seam 27 intervening between the sleeve 26 and the flag field 24. The sleeve 26 diameter is considerably larger than the diameter of the upper pole section 12 to enable the decorative marking flag 22 to freely slip over the top end of the upper pole portion 12 and provide unobstructed rotation of the marking flag 22 about the upper pole 12. The flexible tab 28 containing the grommet 30 or other opening is adapted to slip over the upwardly extending screw 14 to ride on and be supported by the peripheral shoulder 16 of the upper pole section 12. The inner diameter of the grommet opening 30 is larger than the outside diameter of the upright threaded screw 14 to facilitate placing the grommet 30 over the screw 14 and maintain free rotation of the flexible tab 28 and oversize grommet opening 30 around the upright screw 14. The grommet opening 30 is somewhat smaller than the outer diameter of the peripheral shoulder 16 to enable the flexible tab member 28 to rotate around the upright screw 14 while riding on the peripheral shoulder 16. The flexible tab 28 vertically supports the flag 22 and permits 360 degree rotation of the grommet 30 and flag 22 about the axis of the upper pole 12. The capping nut 18 can be secured to the top part of the screw 14 to prevent the tab 28 from dislodging from the top of the upper pole 12 while maintaining rotational movement of the marking flag 22. Typically an adequate vertical spacing is maintained between the bottom surface 20 of the capping nut 18 and the shoulder 16 to permit unobstructed rotation of the tab grommet 30 around the upright screw 14.

A lower end pole section 13 shown in FIG. 1 is preferably inserted into a ground socket 60 disposed into ground 58. The ground socket 60 comprises a conical lower end point 62, a hollow cylindrical intermediate section 64 and a peripheral top collar 66 adapted to be set flush with the ground 58 and remain unobtrusive when not in use. If necessary, an elastomer plug 67 can be fitted into the ground socket opening to maintain centering of the pole section 13 within the ground socket 60 and/or a tightening sleeve or locking ferrule 68 can be fitted to the bottom section 13 of the pole 10, to provide a tight fit between the lower pole end 13 and the inside of the hollow cylinder 64 of the ground socket 60. The ground socket 60 can be sunk permanently into the ground 58 to support the flag pole 10 in accordance with this invention, although the ground socket 60 can be easily removed from the ground 58 with leverage if desired. The flag pole 10 can be easily and quickly removed from the ground socket 60 when desired. Meanwhile the flush set ground socket 60 remains unobtrusive to otherwise subsequent use of the same ground area. The ground socket 60 can be fitted with a protective plug to cap the opening of the ground socket from the elements while not in use. A 6 inch ground socket 60 is adequate for poles 10 less than six feet, while a longer twelve inch ground socket 60 should be used for flag poles 10 six to eight feet or taller. Poles 10 preferably are fiberglass but can be tubular metal or plastic extrusions or conventional solid wood. In a less preferred aspect of this invention, the bottom end 13 of the flag pole 10 can comprise a conical or other sharp edge point which can be inserted directly into the ground without the convenience of a ground socket 60. Flag poles 10 can comprise one or more sections coupled together.

Figure 3:
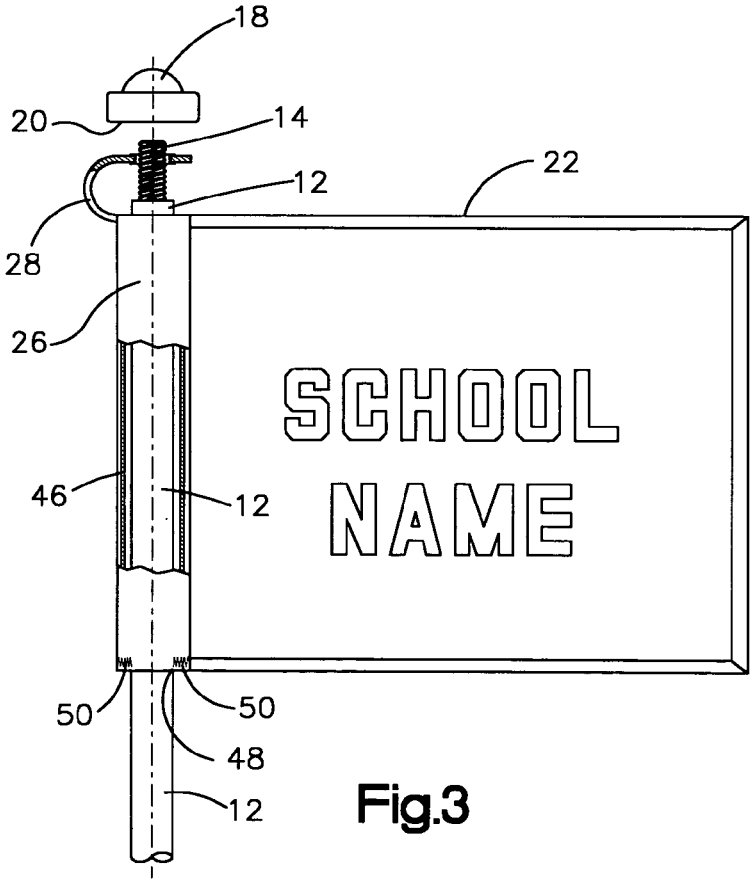
FIG. 3 is a front elevation view of the decorative marking flag in FIG. 2 containing a tubular insert shown in partial section and assembled on the flag pole as shown in FIG. 1.
Figure 4:
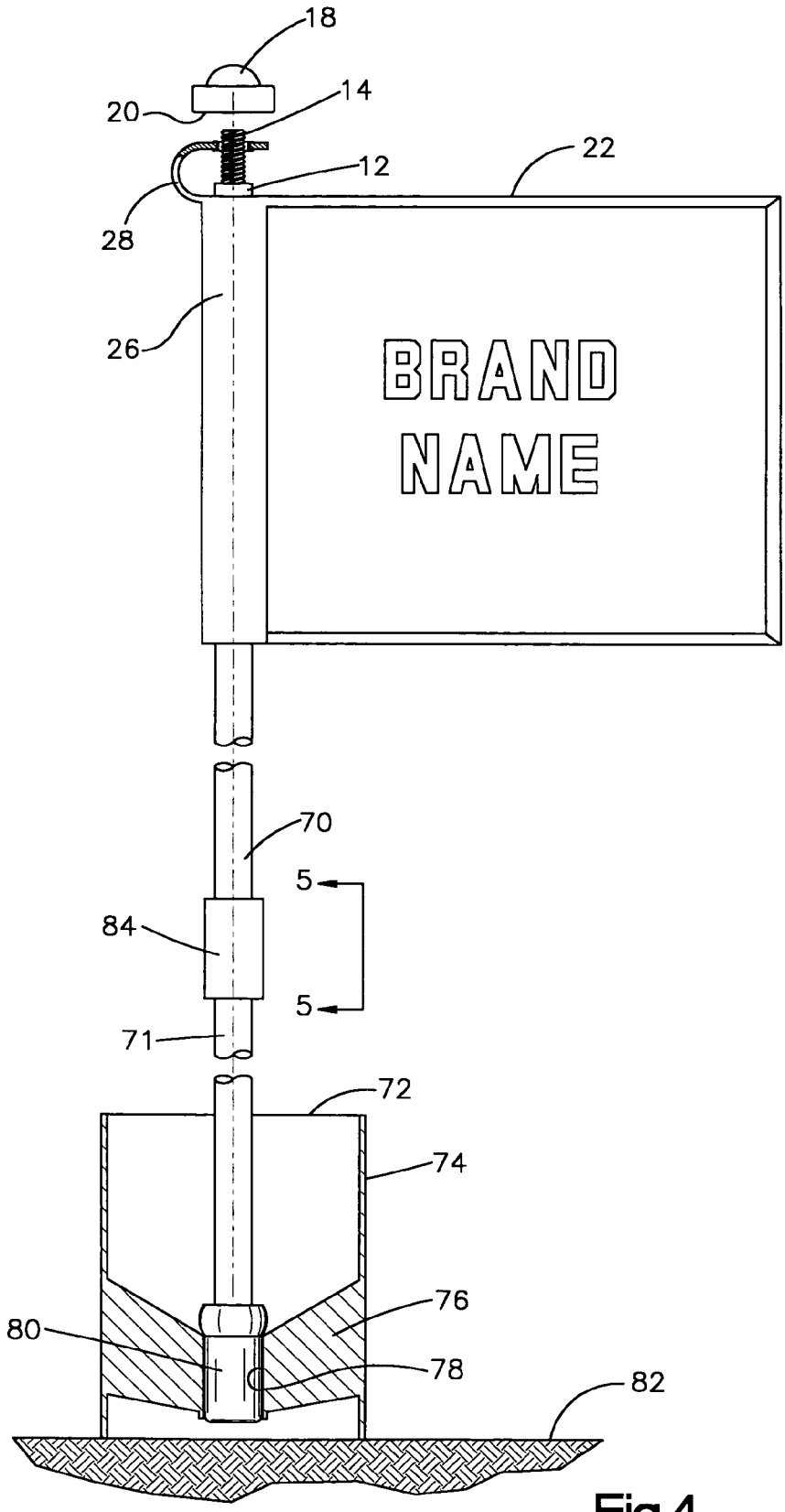
FIG. 4 is a front elevation view similar to FIG. 1, but showing an internal flag of this invention for use inside a building and attached to an interior pole supported by a portable weighted holder shown in vertical section.
Figure 5:
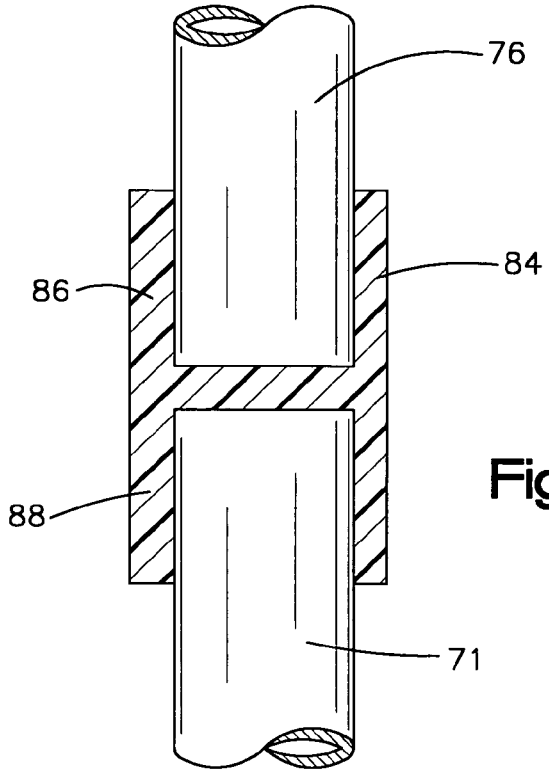
FIG. 5 is a vertical sectional view along lines 5—5 taken in FIG. 4.
Figure 6:
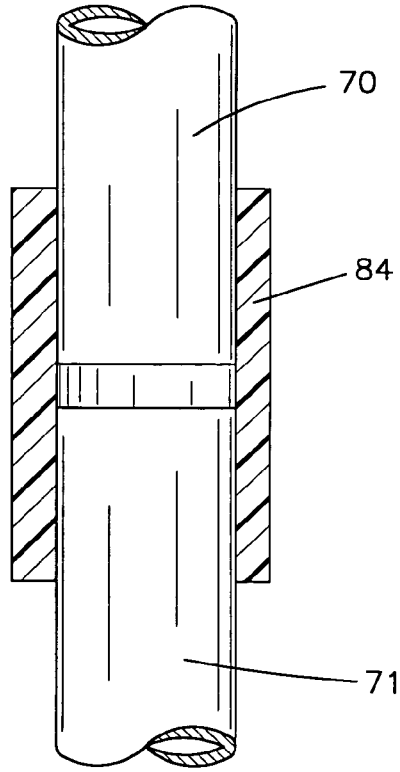
FIG. 6 is an alternative vertical sectional view similar to FIG. 5

In an alternative embodiment of this invention, FIG. 4 illustrates an interior decorative flag 22 attached to a smaller pole assembly 70 and 71 supported by a weighted holder 72 shown in partial vertical sectional view. The flag 22 and pole 70 assemblies can be portable and primarily adapted for display inside residential homes or inside office buildings or other commercial buildings. The weighted holder 72 is shown as a cylindrical cup shape but can be square, triangular, hexagonal or other polygon shape as desired. The holder 72 shown in FIG. 4 comprises a peripheral cylinder 74 with internally directed braces 76 terminating internally with a circular juncture containing a round internal opening 78 adapted to vertically support lower pole section 71. Preferably a small ferrule 80 can be fitted to the bottom of pole section 71 to tightly engage the outer surface of the bottommost area of the pole 70. The ferrule 80 securely fits within the opening 78 to interface with the opening 78 while tightly engaging the bottom of the pole section 71. The weighted holder 72 can be cast metal such as brass or suitable fabricated metal or molded bottom weighted plastic to maintain the pole 70 and flag 22 upright in use. The weighted holder 72 is shown supported on a floor or table top 82 or other stable flat surface. The flag 22 in FIG. 4 is attached to upper pole section 70 in the same manner as flag 22 is attached to upper pole section 12 as shown in FIGS. 1 and 3. Indoor poles 70 resting on furniture ordinarily are smaller typically about one to three feet high, while floor standing poles 70 are larger up to about six feet. Upper and lower pole sections 70 and 71 in FIG. 4 are shown coupled together with a coupling 84 tightly secured to the upper 70 and lower 71 pole section to provide a sturdy pole assembly. In like manner the upper and lower pole sections 10 and 13 shown in FIG. 1 can likewise be an assembled pole structure comprising two or more pole sections coupled together with a coupling 84. For commercial shipping purposes, flag poles 10 can be shipped as pole sections and then assembled as needed to provide a flag pole of a selected height. Advantageously upper pole sections have the coupling 84 secured to the lower end of the pole section facilitate assembly with a lower pole section. A three pole assembly for instance would have a coupling 84 secured to the lower end of the two upper pole sections to facilitate coupling with a lower pole section. The coupling 84 preferably is secured with glue to the upper pole section which seals and prevents rain water leakage within the coupling 84 for flag poles used outdoors. Pre-gluing the coupling 84 to the upper section of a flagpole facilitates secure slip fit assembly and enables disassembly of the pole sections, if desired. A useful coupling 84 is shown in vertical section in FIG. 5 consisting of an "H" shaped structure having an upper cup 86 and lower cup 88 for secure engagement with upper pole section 70 and lower pole section 71 respectively. FIG. 6 is similar to FIG. 5 and illustrates a sleeve structure coupling 84 secured to the upper 70 and lower 71 pole sections. The sleeve structure coupling 84 likewise can be pre-glued to the upper pole section 70 to facilitate assembly of the flagpole 10. The embodiment shown in FIG. 4 is primarily intended for inside use but can be used outdoors on a patio or door step. This configuration is portable and can be carried around as desired to mark parking areas or no parking areas, or to designate driveways, walkways and pathways.

In a desirable aspect of attaching the decorative flag 22 to the upper section 12 of upright pole 10, a cylindrical removable plastic hollow tube 46 can be inserted into the sleeve 26 to facilitate rotation of the flag 22 as well as minimize wear and tear of the flag material against the upper pole section 12. The tube 46 provides extra support for the flag 22 and can be removed and reused in a replacement flag if desired. The plastic tube 46 is inserted within the sleeve 26, as viewed in FIG. 3, and can be maintained and supported within the sleeve 26 by a narrowed bottom opening 48 having a diameter smaller than the external diameter of the plastic tube 46. The bottom end 51 of the sleeve 26 is partially closed by stitching to form a pinched bottom peripheral seam 50 defining the small bottom opening 48 adapted to receive the upper pole section 12. The narrowed opening 48 typically can be formed by partially sewing, glueing, crimping or otherwise partially securing the laterally disposed pinched peripheral bottom seam 50 of the sleeve 26. The surrounding larger diameter plastic tube 46 is vertically supported within the sleeve 26 by the pinched seam 50. The plastic tube insert 46 can be slipped into and retained within the sleeve 26 by the pinched bottom seam 50, while the entire flag 22 can be vertically supported by bending flexible the tab 28 to rotatably engage the upright screw 14, as shown in FIG. 1 in accordance with this invention. An alternative but less preferred mode of vertically supporting the removable plastic tube 46 can be achieved by a narrowed diameter tube adapter secured to the top of the plastic tube 46, where the narrowed adaptor slip fits over the upright screw 14 and rests on the enlarged peripheral shoulder 16. Vertical support of the flag 22 is maintained by the tab 28 rotatably engaging the upright screw 14. The decorative flag of this invention can be directly attached to external or internal flag poles without the necessity of intervening mechanical connectors. The flag integral sleeve connection with the supporting pole in conjunction with the flexible tab connection to the top of the poles enables both vertical support and rotation about the flagpole. The flags can be easily attached to or removed from poles or interchanged as desired, while poles supported by ground sockets, or bottom holes can be easily removed and stored or rearranged as desired. The decorative flags conventionally are about 20 inches by 14 inches and can be smaller or larger as desired as well as different shapes such as square or triangular.

Although preferred aspects of the invention have been described and illustrated in the drawings, and the best mode and preferred embodiment have been set forth, and the invention is not intended to be limited thereby, except by the appended claims.

What is claimed is:

1. A decorative flag in combination with to an upright pole to provide a movable flag and pole assembly, the upright pole having an upwardly extending pin member attached to the upper end of the upright pole, the upwardly extending pin having a reduced thickness smaller than the thickness of the upright pole forming a peripheral lateral shoulder at the juncture of the upwardly extending pin and the upper terminal end of the upright pole, the decorative flag to rotate on the upright pole and readily attachable and detachable from the pole, the decorative flag comprising:

a flag having an attachment side for interconnection with the upright pole, the attachment side having a linear sleeve adapted to loosely slip over the upright pole and enable free rotation of the flag about the upright pole, the linear sleeve having an upper flexible extension tab secured to the uppermost part of the linear sleeve, the extension tab having an opening large enough to rotatably engage the upwardly extending pin but smaller than a diameter of the upright pole to enable the extension tab to rest upon and be supported on the peripheral lateral shoulder between the upright pin and the terminal end of the upright pole, where the extension tab vertically supports the decorative flag on the upright pole while permitting rotational movement of the flag about the upright pole; and wherein the flag sleeve is slipped over the pole and the flexible tab rotatably engages the extending pin while maintaining vertical support of the flag on the pole.

2. The decorative flag and in claim 1 where the upright pole and upwardly extending pin are circular, where the tab opening is larger than the diameter of the extending pin but smaller than the diameter of the upright pole to provide rotatable support of the marking flag on the upright pole, and a capping member secured to the top of the upwardly extending pin to prevent dislodgment of the flexible tab from the extension pin while permitting rotation of the flexible tab about the extension pin.

3. The combination as stated in claim 1 where the opening in the tab has a metal grommet placed on the opening.

4. The combination as stated in claim 1 where the flag sleeve contains a removable tubular insert with an inside diameter larger than the diameter of the upright pole to facilitate rotation of the decorative flag about the upright pole.

5. The combination as stated in claim 4 where the tubular insert is a plastic tube.

6. The combination as stated in claim 4 where the bottom end of the linear sleeve is partially closed to provide a narrowed opening in the bottom end of the sleeve, the tubular insert having an outside diameter larger than the narrowed opening in the sleeve to prevent the tubular insert from falling out of the linear sleeve.

7. The combination as stated in claim 1 where the upright pole is removably supported in a ground socket.

8. The combination as stated in claim 1 where the upright pole is vertically supported in a freestanding weighted holder attached to the bottom of the pole.

9. The decorative flag in claim 8 where the pole is removable from the weighted holder.

10. The combination as stated in claim 1 where the flag is interchangeable.

11. A decorative flag in combination with an upright pole, the flag and upright pole being movable, the flag adapted to be rotatably supported on the upright pole, the upright pole having an upwardly extending narrowed extension pin of reduced thickness smaller than the thickness of the upright pole forming a peripheral lateral shoulder at the juncture of the upper extending pin and upper terminal end of the upright pole, the decorative flag comprising:

an attachment side for attachment to the upright pole, the attachment side having a linear sleeve adapted to loosely slip over the upright pole, the sleeve having an upper flexible extension pin tab with an opening to loosely engage the narrowed extension pin on the top of the upright pole, the flexible extension tab rotatably supported by the narrowed extension pin on the upright pole, the flexible extension tab vertically supporting the flag on the upright pole while the linear sleeve is rotatably attached to the upright pole.

* * * * *